US005505595A

United States Patent [19]

Fukui

[11] Patent Number: 5,505,595

[45] Date of Patent: Apr. 9, 1996

[54] SCROLL TYPE FLUID DISPLACEMENT APPARATUS HAVING AXIAL MOVEMENT REGULATION OF THE DRIVING MECHANISM

[75] Inventor: Tsuyoshi Fukui, Isesaki, Japan

[73] Assignee: Sanden Corporation, Gunma, Japan

[21] Appl. No.: 358,317

[22] Filed: Dec. 19, 1994

[30] Foreign Application Priority Data

Dec. 20, 1993 [JP] Japan ..... 5-344555

[51] Int. Cl.[6] ..... F01C 1/04; F01C 21/02

[52] U.S. Cl. ..... 418/55.1; 418/55.6; 418/107; 384/626

[58] Field of Search ..... 418/55.1, 55.5, 418/55.6, 57, 94, 107; 384/424, 626

[56] References Cited

U.S. PATENT DOCUMENTS

| | | | |
|---|---|---|---|
| 1,156,700 | 10/1915 | May | 418/96 |
| 1,906,142 | 4/1933 | Ekelof | 418/59 |
| 3,874,827 | 4/1975 | Young | 418/57 |
| 4,466,784 | 8/1984 | Hiraga | 418/104 |
| 4,512,729 | 4/1985 | Sakamoto et al. | 418/151 |
| 4,725,153 | 2/1988 | Tsuruki | 384/626 |
| 4,892,469 | 1/1990 | McCullough et al. | 418/55.5 |
| 4,900,238 | 2/1990 | Shigemi et al. | 418/149 |
| 4,910,846 | 3/1990 | Andreasson et al. | 384/626 |
| 5,000,669 | 3/1991 | Shimizu et al. | 418/55.6 |

FOREIGN PATENT DOCUMENTS

| | | | |
|---|---|---|---|
| 535830 | 1/1957 | Canada . | |
| 0538892 | 4/1993 | European Pat. Off. | 418/55.1 |

*Primary Examiner*—John J. Vrablik
*Attorney, Agent, or Firm*—Baker & Botts

[57] ABSTRACT

A scroll-type fluid displacement apparatus includes a compressor housing, which contains a compression mechanism and a driving mechanism operatively connected to one another. The compression mechanism includes a fixed scroll and an orbiting scroll interfitting at angular and radial offsets, and a rotation preventing mechanism which prevents rotation of the orbiting scroll during its orbital motion. The driving mechanism includes a drive shaft axially disposed within the housing and rotatably supported by an inner block, which is fixedly disposed within the housing. An axial movement regulating mechanism for regulating an axial movement of the driving mechanism is disposed between the inner block and an internal component of the compressor axially spaced from the inner block. The regulating mechanism includes an annular flange extending from an exterior surface of the drive shaft and a shim which is detachably disposed either between the annular flange and the inner block or between the annular flange and the internal component.

18 Claims, 8 Drawing Sheets

SCROLL TYPE FLUID DISPLACEMENT APPARATUS HAVING AXIAL MOVEMENT REGULATION OF THE DRIVING MECHANISM

BACKGROUND OF THE INVENTION

1. Field of the Invention

This invention relates to a scroll-type fluid displacement apparatus and, more particularly, to a regulating mechanism for regulating an axial movement of a driving mechanism of the apparatus.

2. Description of the Related Art

FIGS. 1 and 2 illustrate a scroll-type fluid displacement apparatus, such as a scroll-type refrigerant compressor in accordance with the prior art.

In FIGS. 1 and 2, for purposes of explanation only, the left side of the figures will be referred to as the forward end or front of the compressor, and the right side of the figures will be referred to as the rearward end or rear of the compressor.

As shown in FIG. 1, compressor 300 includes compressor housing 310 having front end plate 311 and cup-shaped casing 312 which is secured to the rear end surface of front end plate 311 by a plurality of bolts 313. An opening 311*a* is formed in the center of front end plate 311 for penetration or passage of a drive shaft 314, which is made of steel. An opening end of cup-shaped casing 312 is covered by front end plate 311, and the mating surfaces between front end plate 311 and cup-shaped casing 312 are sealed by a first O-ring 315. First annular sleeve 311*b* forwardly projects from a periphery of opening 311*a* so as to surround a front end portion of drive shaft 314 and define shaft seal cavity 311*c* therein. A mechanical seal element 314*d* is disposed within shaft seal cavity 311*c* and is mounted about drive shaft 314.

Drive shaft 314 is rotatably supported by first annular sleeve 311*b* through radial needle bearing 316, which is positioned within the front end of first annular sleeve 311*b*. Second annular sleeve 311*d* rearwardly projects from the periphery of opening 311*a* so as to surround an inner end portion of drive shaft 314.

Inner block 320 having front annular projection 321 and rear annular projection 322 is disposed within an interior of housing 310. The interior of housing 310 is defined by the inner wall of cup-shaped casing 312 and the rear end surface of front end plate 311. Inner block 320 is fixedly attached to front end plate 311 at its front annular projection 321 by a plurality of bolts 317, so that front annular projection 321 of inner block 320 surrounds second annular sleeve 311*d* of front end plate 311, and so that a front end surface of front annular projection 321 is in contact with the rear end surface of front end plate 311.

Drive shaft 314 has cylindrical rotor 314*a* which is integral with and coaxially projects from an inner end surface of drive shaft 314. A diameter of cylindrical rotor 314*a* is greater than that of drive shaft 314. Cylindrical rotor 314*a* is rotatably supported by inner block 320 through radial plane bearing 325 which is fixedly disposed within opening 323 centrally formed through inner block 320. Radial plane bearing 325 is fixedly disposed within opening 323 by, for example, forcible insertion. Pin member 314*b* is integral with, and projects from, a rear end surface of cylindrical rotor 314*a*. An axis of pin member 314*b* is radially offset from an axis of cylindrical rotor 314*a*, i.e., an axis of drive shaft 314, by a predetermined distance.

An electromagnetic clutch 318, which is disposed around first annular sleeve 311*b*, includes a pulley 318*a* rotatably supported on sleeve 311*b* through ball bearing 318*b*, an electromagnetic coil 318*c* disposed within an annular cavity of pulley 318*a*, and an armature plate 318*d* fixed on an outer end of drive shaft 314, which extends from sleeve 311*b*. Drive shaft 314 is connected to and driven by an external power source through electromagnetic clutch 318.

The interior of housing 310 further accommodates a fixed scroll 330, an orbiting scroll 340, and a rotation preventing mechanism (such as Oldham coupling mechanism 350), which prevents rotation of orbiting scroll 340 during operation of the compressor.

Fixed scroll 330 includes circular end plate 331, a first spiral element 332 affixed to or extending from a front side surface of circular end plate 331, and an outer peripherial wall 333 forwardly projecting from an outer periphery of circular end plate 331. Outer peripheral wall 333 of fixed scroll 330 is fixedly attached to rear annular projection 322 of inner block 320 by a plurality of bolts 319, so that a rear end surface of rear annular projection 322 of inner block 320 is in contact with a front end surface of outer peripheral wall 333 of fixed scroll 330. Thus, fixed scroll 330 is fixedly disposed within the interior of housing 310.

A second O-ring 334 is elastically disposed between an outer rear peripheral surface of circular end plate 331 and an inner peripheral surface of cylindrical portion 312*a* of cup-shaped casing 312 to seal the mating surfaces therebetween. Thus, a first chamber section 360 is defined by circular end plate 331 of fixed scroll 330 and a rear portion 312*b* of cup-shaped casing 312. A third O-ring 324 is elastically disposed between an outer rear peripheral surface of rear annular projection 322 of inner block 320 and the inner peripheral surface of cylindrical portion 312*a* of cup-shaped casing 312 to seal the mating surfaces therebetween. Thus, a second chamber section 370 is defined by circular end plate 331 of fixed scroll 330, a part of cylindrical portion 312*a* of cup-shaped casing 312 and inner block 320. Also a third chamber section 380 is defined by inner block 320, a part of cylindrical portion 312*a* of cup-shaped casing 312 and front end plate 311.

Inlet port 310*a* is formed on cylindrical portion 312*a* of cup-shaped casing 312 at a position corresponding second chamber section 370 to place second chamber section 370 in communication with the exterior of compressor 300. Outlet port 310*b* is formed on cylindrical portion 312*a* of cup-shaped casing 312 at a position corresponding third chamber section 380 to place third chamber section 380 in communication with the exterior of compressor 300.

A plurality of fluid passages (not shown) are axially formed through outer peripheral wall 333 of fixed scroll 330 and rear annular projection 322 of inner block 320 along the periphery thereof so as to link first chamber section 360 to third chamber section 380. Though the above fluid passages are not shown in the drawings, they are located in the vicinity of holes 333*a*, through which shaft portions of bolts 319 penetrate.

A hole or discharge port 335 is formed through circular end plate 331 of fixed scroll 330 at a position near the center of first spiral element 332. Reed valve member 336 cooperates with discharge port 335 at a rear end surface of circular end plate 331 of fixed scroll 330 to control the opening and closing of discharge port 335 in response to a pressure differential between first chamber section 360 and a central fluid pocket 390*a*. Retainer 337 is provided to prevent excessive bending of reed valve member 336 when discharge port 335 is opened. An end of reed valve member 336 is fixedly secured to circular end plate 331 of fixed scroll 330 by a single bolt 338, together with an end of retainer 337.

Orbiting scroll 340, which is located in second chamber section 370, includes circular end plate 341 and a second spiral element 342 affixed to or extending from a rear end surface of end plate 341. Second spiral element 342 of orbiting scroll 340 and first spiral element 332 of fixed scroll 330 interfit at an angular offset of 180° and a predetermined radial offset to make a plurality of line contacts. Therefore, at least one pair of sealed-off fluid pockets 390 are defined between spiral elements 332 and 342.

Referring also to FIG. 2, orbiting scroll 340 further includes an annular boss 343, which forwardly projects from a central region of a front end surface of circular end plate 341. Bushing 344 is rotatably disposed within boss 343 through radial plane bearing 345. Radial plane bearing 345 is fixedly disposed within boss 343 by, for example, forcible insertion. Bushing 344 has a hole 344*a* axially formed therethrough. An axis of hole 344*a* is radially offset from an axis of bushing 344. As described above, pin member 314*b* is integral with, and projects from, the rear end surface of cylindrical rotor 314*a* of drive shaft 314. The axis of pin member 314*b* is radially offset from the axis of cylindrical rotor 314*a*, i.e., the axis of drive shaft 314 by a predetermined distance.

Pin member 314*b* is rotatably disposed within hole 344*a* of bushing 344. A terminal end portion of pin member 314*b* projects from a rear end surface of bushing 344, and snap ring 346 is fixedly secured to the terminal end portion of pin member 314*b* to prevent axial movement of pin member 314*b* within hole 344*a* of bushing 344. Thus, drive shaft 314, pin member 314*b* and bushing 344 form a driving mechanism for orbiting scroll 340. Counter balance weight 347 is disposed within second chamber section 370 at a position forward from circular end plate 341 of orbiting scroll 340, and is connected to a front end of bushing 344. Annular flange 314*c* is made of steel, for example, and is formed at a position which constitutes a boundary between the inner end portion of drive shaft 314 and cylindrical rotor 314*a*. A diameter of annular flange 314*c* is greater than the diameter of cylindrical rotor 314*a*.

First thrust plane bearing 326 is fixedly disposed within an annular cut-out portion 311*e*, which is formed at an outer peripheral region of the rear end surface of second annular sleeve 311*d*, by a plurality of fixing pins 326*a*. A rear end surface of first thrust plane bearing 326 slightly projects from the rear end surface of second annular sleeve 311*d*. The rear end surface of first thrust plane bearing 326 faces the front end surface of annular flange 314*c*. A rear end surface of fixing pins 326*a* is forward of the rear end surface of first thrust plane bearing 326. First thrust plane bearing 326 may be in frictional contact with annular flange 314*c*, and may receive a forward thrust force through annular flange 314*c*.

Second thrust plane bearing 327, which is substantially identical to first thrust plane bearing 326, is fixedly disposed within a shallow annular depression 320*a*, which is formed at the from end surface of inner block 320 along a periphery of opening 323, by a plurality of fixing pins 327*a*. Second thrust plane bearing 327 surrounds a front end portion of radial thrust bearing 325, and faces the rear end surface of annular flange 314*c*. A front end surface of second thrust plane bearing 327 slightly projects from the from-end surface of inner block 320. A front end surface of fixing pins 327*a* is rearward of the from top end surface of second thrust plane bearing 327. Second thrust plane bearing 327 may be in frictional contact with annular flange 314*c*, and may receive a rearward thrust force through annular flange 314*c*.

With reference to FIG. 3, first thrust plane bearing 326 includes a first annular element 326*b* and second annular element 326*c* which is disposed on one end surface of first annular element 326*b*. First annular element 326*b* is made of, for example, steel and second annular element 326*c* is made of, for example, phosphor bronze (which is softer than steel). First and second annular elements 326*b* and 326*c* are fixedly bonded to each other by, for example, sintering. First thrust plane bearing 326 further includes a plurality of radial grooves 326*d* which are formed at an axial outer end surface of second annular element 326*c*.

With reference to FIG. 2 in addition to FIG. 3, second annular element 326*c* of phosphor bronze faces annular flange 314*c* of steel, so that first thrust plane bearing 326 can be in frictional contact with annular flange 314*c* in a soft-to-hard-metal contact. As a result, abrasion resistance of the frictional contact surfaces between first thrust plane bearing 326 and annular flange 314*c* is increased. As shown in FIG. 3, thickness $L_1$ of first annular element 326*b* may be designed to be sufficiently greater than thickness $L_2$ of second annuler element 326*c*. For example, thickness $L_1$ of first annular element 326*b* may be designed to be 1.2 mm and thickness $L_2$ of second annular element 326*c* may be designed to be 0.3 mm. Furthermore, the construction of second thrust plane bearing 327 is similer to that of first thrust plane bearing 326 and, therefore, an explanation thereof is omitted.

Referring again to FIG. 2, fluid passage 371 is axially formed through pin member 314*b* and cylindrical rotor 314*a*. One end of fluid passage 371 is open to an axial air gap 372 created between the rear end surface of bushing 344 and the front end surface of circular end plate 341 of orbiting scroll 340. The other end of fluid passage 371 is open to a radial air gap 381 created between an inner peripheral surface of second annular sleeve 311*d* and an outer peripheral surface of the inner end portion of drive shaft 314. Radial air gap 381 is linked to a hollow space 382, which is defined by second annular sleeve 311*d* of front end plate 311 and front annular projection 321 of inner block 320, through either an axial air gap 383 created between annular flange 314*c* and first thrust plane bearing 326 or radial grooves 326*d* formed at the axial outer end surface of second annular element 326*c* of first thrust plane bearing 326. Hollow space 382 is linked to a lower portion of third chamber section 380 through conduit 328 which is radially formed through inner block 320. Capillary tube element 329 is fixedly disposed within conduit 328. Filter member 329*a* is fixedly attached to a lower end of capillary tube element 329.

Aforementioned Oldham coupling mechanism 350, functioning as the rotation preventing device for orbiting scroll 340, is disposed between circular end plate 341 of orbiting scroll 340 and rear annular projection 322 of inner block 320. By providing Oldham coupling mechanism 350, the rotation of drive shaft 314 causes orbiting scroll 340 to orbit without rotating.

With reference to FIG. 4, radial plane bearing 325 includes a first annular cylindrinal element 325*a* and second annular cylindrical element 325*b*, which is radially surrounded by an inner peripheral surface of first annular cylindrical element 325*a*. First annular cylindrical element 325*a* is made of, for example, steel. Second annular cylindrical element 325*b* is made of, for example, phosphor bronze (which is softer than steel). First and second annular cylindrical elements 325*a* and 325*b* are fixedly bonded to each other by, for example, sintering.

Referring further to FIG. 2, an inner peripheral surface of second annular cylindrical element 325*b* of phosphor bronze faces an outer peripheral surface of cylindrical rotor 314*a*, which is made of steel. This radial plane bearing 325 is in frictional contact with cylindrical rotor 314*a* in a soft-to-hard-metal contact. As a result, the abrasion resistance of the frictional contact surfaces between radial plane bearing 325 and cylindrical rotor 314*a* is increased. As shown in FIG. 4, thickness $L_3$ of first annular cylindrical element 325*a* is designed to be sufficiently greater than thickness $L_4$ of second annular cylindrical element 325*b*. For example, thickness $L_3$ of first annular cylindrical element 325*a* may be designed to be 1.7 mm and thickness $L_4$ of second annular cylindrical element 325*b* may be designed to be 0.3 min. Furthermore, the construction of radial plane bearing 345 is similar to that of radial plane bearing 325 and, therefore, an explanation thereof is omitted.

Because of cost, weight reduction, and durability considerations, radial plane bearings 325 and 345 and first and second thrust plane bearings 326 and 327 (as described above) are typically superior to conventional bearings, such as a ball-type bearings.

During operation, as orbiting scroll 340 orbits, the line contacts between spiral elements 332 and 342 move toward the center of these spiral elements along the spiral curved surfaces of spiral elements 332 and 342. This causes the fluid pockets 390 to move to the center with a consequent reduction in volume and compression of the fluid (e.g., refrigerant) in the fluid pockets 390. Refrigerant gas, which is introduced from a component, such as an evaporator (not shown) of a refrigerant circuit (not shown), through fluid inlet port 310*a*, is taken into the fluid pockets 390 formed between spiral elements 332 and 342 from the outer end portion of the spiral elements.

The refrigerant gas taken into the fluid pockets 390 is then compressed and discharged through discharge port 335 into first chamber section 360 from the central fluid pocket 390*a* of spiral elements 332 and 342. Thereafter, the refrigerant gas in first chamber section 360 flows to third chamber section 380 through the aforementioned fluid passages (not shown), which are axially formed through outer peripheral wall 333 of fixed scroll 330 and rear annular projection 322 of inner block 320. The refrigerant gas flowing into third chamber section 380 further flows through fluid outlet port 310*b* to another component, such as a condenser (not shown) of the refrigerant circuit (not shown).

Referring to FIGS. 1 and 2, the lubricating oil accumulated at a bottom portion of the interior of first chamber section 360 flows into the bottom portion of the interior of third chamber section 380 through the aforementioned fluid passages (not shown), which are axially formed through outer peripheral wall 333 of fixed scroll 330 and rear annular projection 322 of inner block 320. The lubricating oil in the bottom portion of the interior of third chamber section 380 is conducted into a hollow space 373 of second chamber section 370 created between inner block 320 and circular end plate 341 of orbiting scroll 340 by virtue of the pressure differential between third chamber section 380 and second chamber section 370 via conduit 328, hollow space 382, either axial air gap 383 or radial grooves 326*d* of first thrust plane bearing 326 (shown in FIG. 3), fluid passage 371, axial air gap 372, and radial air gaps created between boss 343 and radial plane bearing 345 and between bushing 344 and radial plane bearing 345. The lubricating oil conducted into hollow space 373 flows through second chamber section 370 at a position which is outside spiral elements 332 and 342, and past Oldham coupling mechanism 350 to lubricate mechanism 350.

Further, a part of the lubricating oil which is conducted to radial air gap 381 flows to shaft seal cavity 311*c*, and lubricates the internal frictional surfaces of mechanical seal element 314*d* and the frictional surfaces between mechanical seal element 314*d* and drive shaft 314.

Moreover, a part of the lubricating oil which is conducted to hollow space 382 flows through radial grooves 327*d* of second thrust plane bearing 327 (shown in FIG. 3), and then flows into hollow space 373 of second chamber section 370 through a radial air gap created between an outer peripheral surface of radial plane bearing 325 and an inner peripheral surface of opening 323 of inner block 320 and through a radial air gap created between an inner peripheral surface of radial plane bearing 325 and an outer peripheral surface of cylindrical rotor 314*a*.

A part of the lubricating oil which is conducted to hollow space 373 flows into axial air gap 372 through a radial air gap created between an outer peripheral surface of radial plane bearing 345 and an inner peripheral surface of boss 343 and through a radial air gap created between an inner peripheral surface of radial plane bearing 345 and an outer peripheral surface of bushing 344.

As the lubricating oil flows from the bottom portion of the interior of third chamber section 380 to second chamber section 370 as described above, the frictional surfaces of the internal components of the compressor, such as the frictional surface between bushing 344 and radial plane bearing 345 are effectively lubricated by the lubricating oil.

According to these features, when the compressor is assembled, positive tolerant axial air gaps must be created between the following pairs of adjacent surfaces (shown in FIG. 2) in order to prevent defective interferences therebetween.

(A) the adjacent surfaces of bushing 344 and circular end plate 341 of orbiting scroll 340;

(B) the adjacent surfaces of counter balance weight 347 and boss 343 of orbiting scroll 340;

(C) the adjacent surfaces of counter balance weight 347 and Oldham coupling mechanism 350;

(D) the adjacent surfaces of counter balance weight 347 and inner block 320;

(E) the adjacent surfaces of annular flange 314*c* and second annular sleeve 311*d*; and (F) the adjacent surfaces of annular flange 314*c* and inner block 320;

Further, in contrast with a conventional bearing device, such as a radial ball bearing which includes inner and outer races and a plurality of ball elements rollingly disposed between the races, no preventing element for preventing axial movement of drive shaft 314 is provided between drive shaft 314 and radial plane bearings 325 and 345 and between drive shaft 314 and radial needle bearing 316. As a result, during operation of the compressor 300, drive shaft 314 may forwardly and rearwardly slide along the inner peripheral surfaces of radial plane bearings 325 and 345 and the inner peripheral surface of radial needle bearing 316 due to the positive tolerant axial air gaps described above.

Accordingly, during operation of the compressor 300, as drive shaft 314 rearwardly moves, a collision may occur between one or more of the above-described adjacent surfaces (A), (B), (C) and (F) having the smallest positive tolerant axial air gap. As drive shaft 314 forwardly moves, a collision may occur between one or more of the above-described adjacent surfaces (D) and (E) having the smaller positive tolerant axial air gap. These collisions may cause an offensive noise and an abnormal abrasion at the colliding adjacent surfaces.

In order to prevent the above defects, as illustrated in FIG. 2, first and second thrust plane bearings 326 and 327 are provided at the rear end surface of second annular sleeve 311*d* and the front end surface of inner block 320, respectively. In addition, the positive tolerant axial air gap 383 created between the front end surface of annular flange 314*c* and the rear end surface of first thrust plane bearing 326 is designed to be smaller than the positive tolerant axial air gap created between the adjacent surfaces (D). Also, the positive tolerant axial air gap created between the rear end surface of annular flange 314*c* and the front end surface of second thrust plane bearing 327 is designed to be smaller than the positive tolerant axial air gap created between any of the pairs of adjacent surfaces (A), (B) and (C). As a result, the forward and rearward movements of drive shaft 314 are limited by first and second thrust plane bearings 326 and 327, respectively. Since first and second thrust plane bearings 326 and 327 are constructed as illustrated in FIG. 3, offensive noise and abnormal abrasion are reduced.

However, the positive tolerant axial air gap 383 created between the front end surface of annular flange 314*c* and the rear end surface of first thrust plane bearing 326 becomes relatively large, for example, 0.1 mm–0.5 mm, due to precision limitations during the machining of inner block 320 having front annular projection 321, front end plate 311 having second annular sleeve 311*d*, and drive shaft 314 having annular flange 314*c*. Similarly, the positive tolerant axial air gap created between the rear end surface of annular flange 314*c* and the front end surface of second thrust plane bearing 327 also becomes relatively large, for example, 0.1 mm–0.5 mm, due to also the above-referenced machining precision limitations.

Thus, offensive noise and abnormal abrasion at the contact surfaces between annular flange 314*c* and first thrust plane bearing 326 and between annular flange 314*c* and second thrust plane bearing 327 are not sufficiently reduced.

SUMMARY OF THE INVENTION

Accordingly, it is an object of the present invention to provide a scroll-type fluid displacement apparatus in which an offensive noise and an abnormal abrasion caused by collisions at the contact surfaces between a drive shaft and the internal components axially adjacent thereto are sufficiently reduced.

It is also an object of the present invention to reduce the manufacturing cost, reduce the weight, and increase the durability of the compressor.

In order to obtain the above objects, an embodiment of the present invention provides a scroll-type fluid displacement apparatus which includes a housing, a fixed scroll having a first end plate from which a first spiral element extends and an orbiting scroll having a second end plate from which a second spiral element extends.

The first and second spiral elements interfit at angular and radial offsets to form a plurality of linear contacts defining at least one pair of sealed-off fluid pockets. A driving mechanism includes a drive shaft which is axially disposed in the housing and is operatively connected to the orbiting scroll to effect the orbital motion of the orbiting scroll.

An inner block is fixedly disposed within the housing so as to rotatably support a portion of the drive shaft. A rotation-preventing mechanism is coupled to the orbiting scroll to prevent rotation of the orbiting scroll during its orbital motion, such that the volume of the at least one pair of sealed-off fluid pocket changes.

The compressor further includes an axial movement regulating mechanism for regulating axial movement of the driving mechanism. The axial movement regulating device includes an annular flange which radially extends from an exterior surface of the drive shaft and is disposed between an axial end surface of the inner block and an axial end surface of an internal component, which is axially spaced from the inner block. The regulating mechanism also includes a shim which is detachably disposed either between the annular flange and the inner block or between the annular flange and the internal component.

DETAILED DESCRIPTION OF THE PREFERRED EMBODIMENTS

Figure 1:
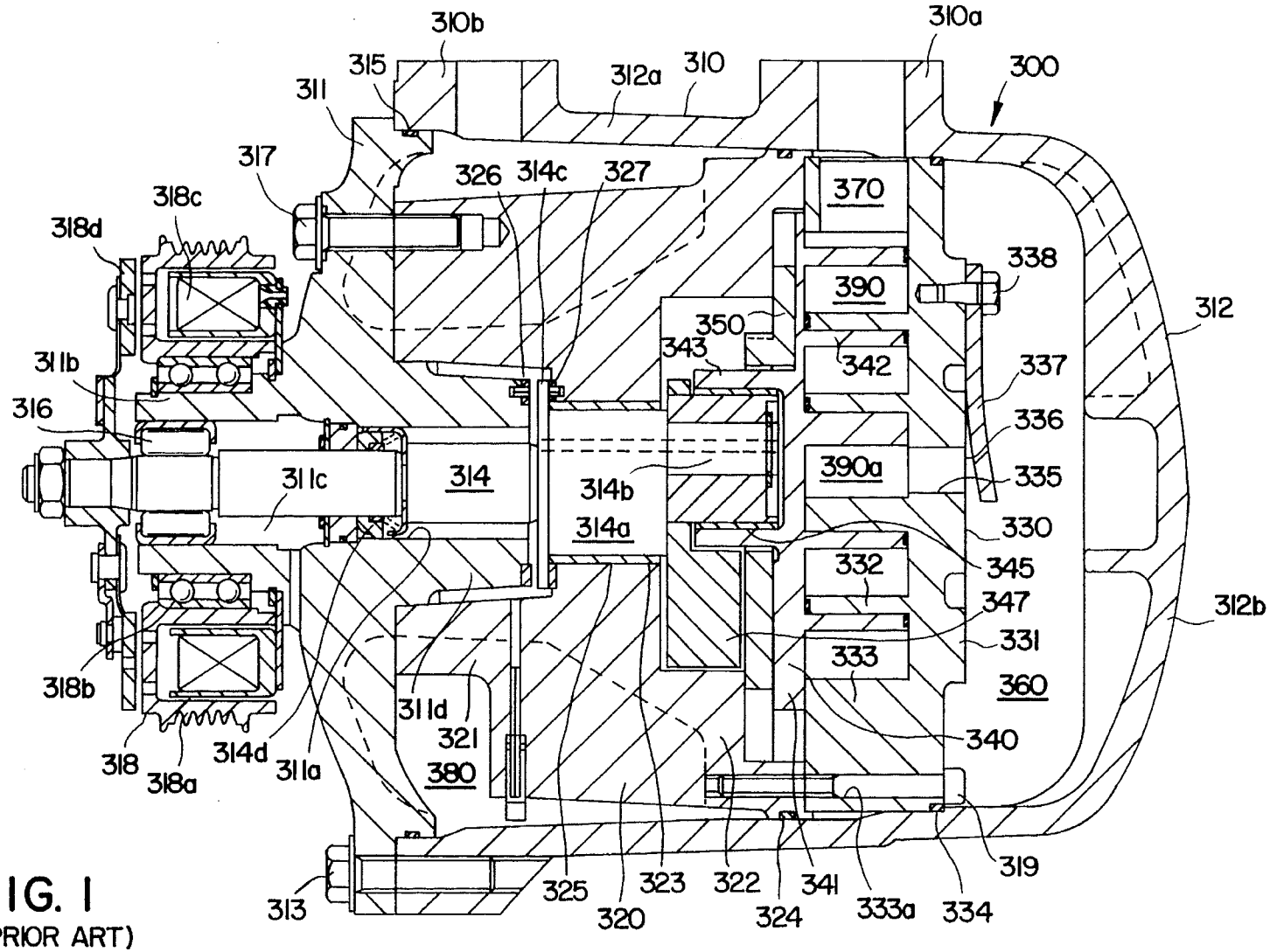
FIG. 1 (PRIOR ART)
FIG. 1 is a longitudinal sectional view of a scroll-type fluid displacement apparatus in accordance with the prior art.
Figure 2:
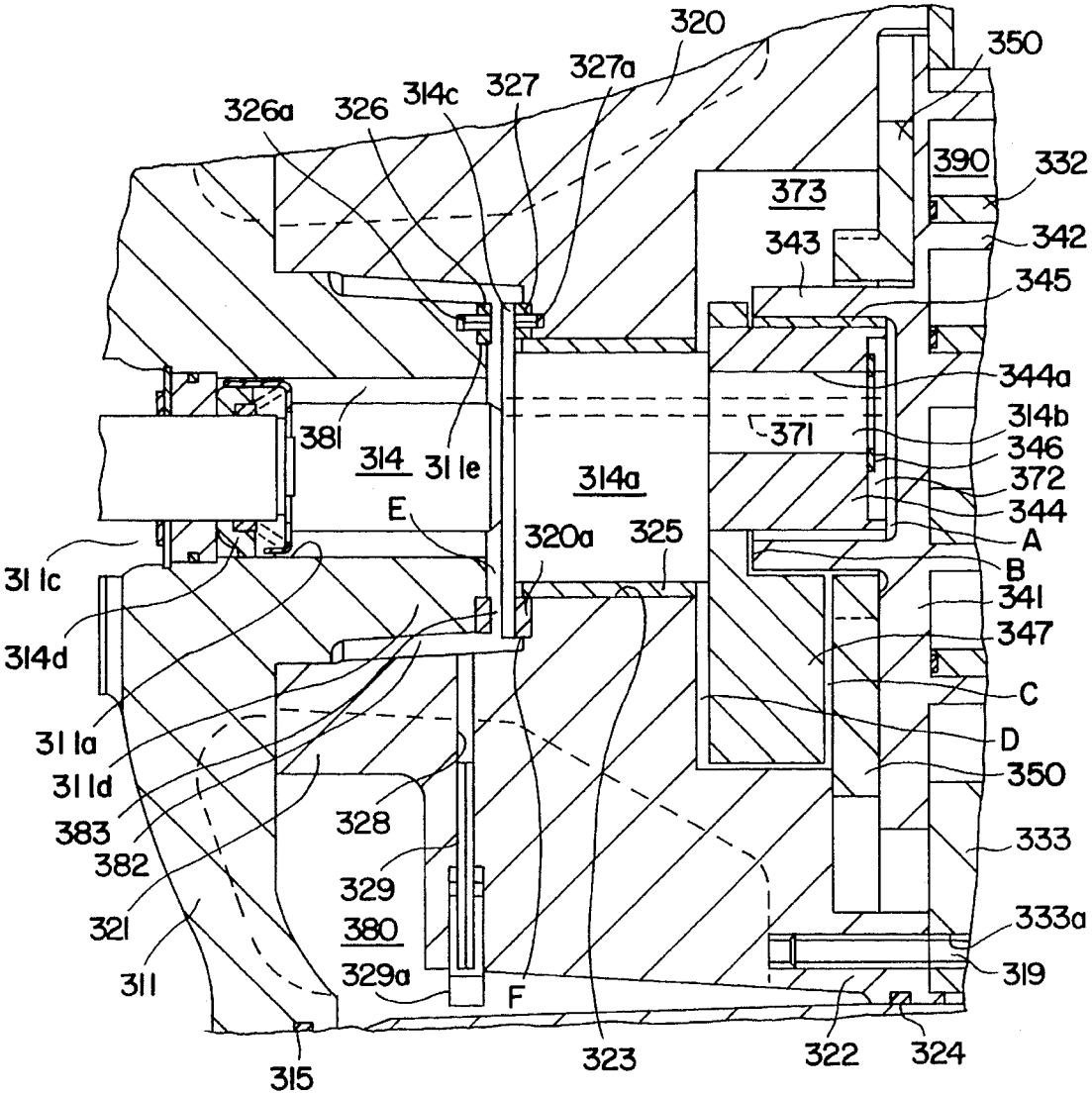
FIG. 2 (PRIOR ART)
FIG. 2 is an enlarged partial longitudinal sectional view of the scroll-type fluid displacement apparatus shown in FIG. 1.
Figure 3:
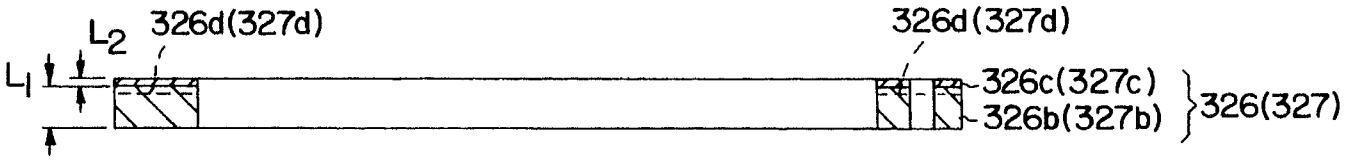
FIG. 3 is an enlarged cross-sectional view of a thrust plane bearing of the apparatus shown in FIG. 1.
Figure 4:
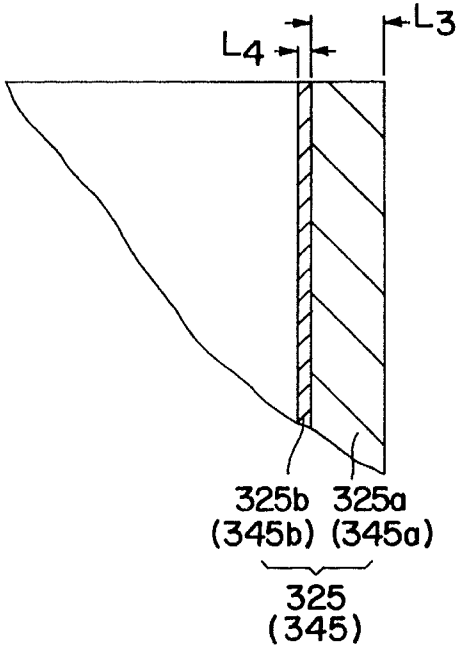
FIG. 4 is an enlarged partial cross-sectional view of a radial plane bearing of the apparatus shown in FIG. 1.
Figure 5:
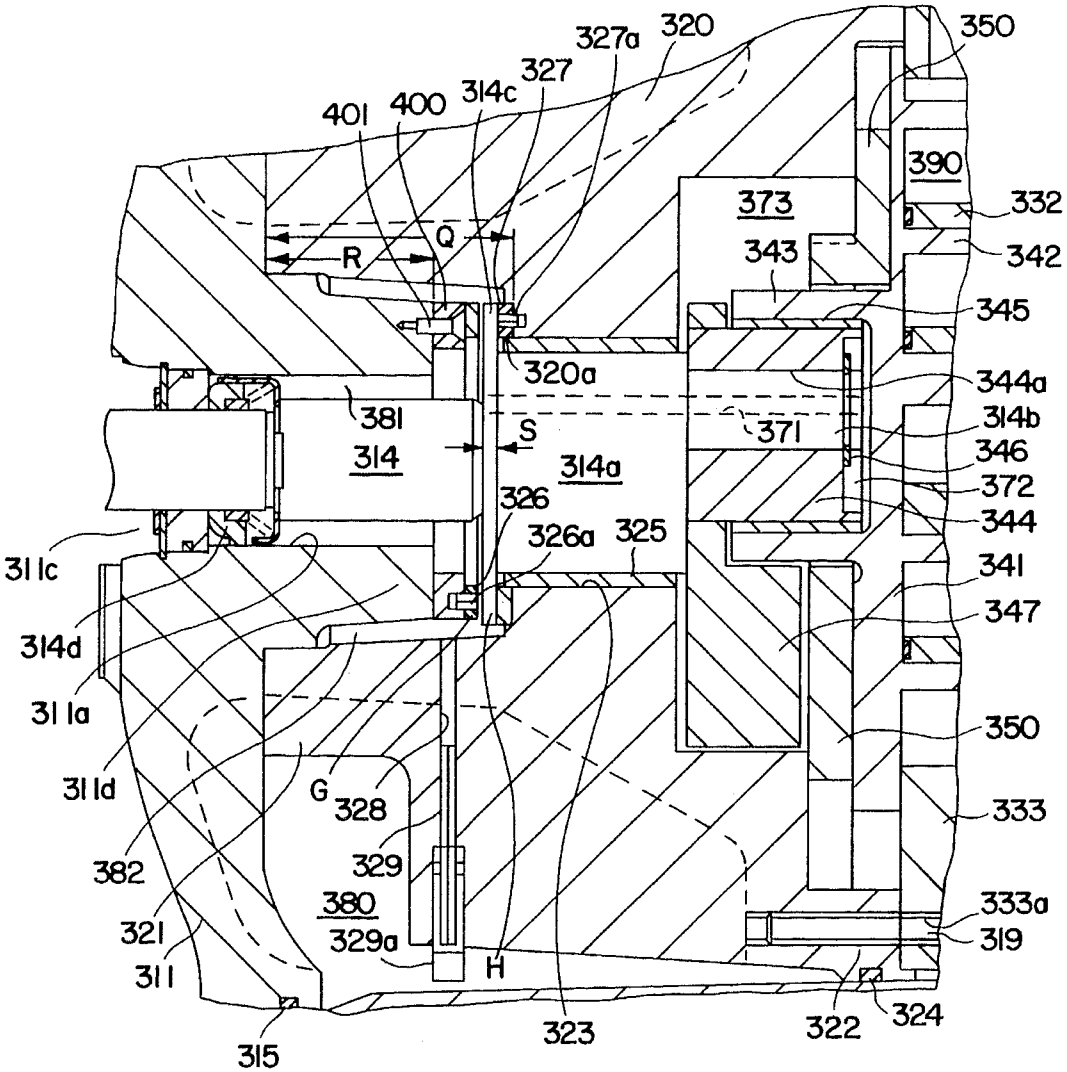
FIG. 5 is an enlarged partial cross-sectional view of a scroll-type fluid displacement apparatus in accordance with a first embodiment of the present invention.

FIG. 5 shows a scroll-type fluid displacement apparatus in accordance with a first embodiment of the present invention. The same numerals are used in FIG. 5 to denote certain corresponding elements shown in FIGS. 1 and 2, a detailed explanation of which is omitted. Further, in FIG. 5, for purposes of explanation only, the left side of the figure will be referred to as the forward end or front of the compressor, and the right side of the figure will be referred to as the rearward end or rear of the compressor.

With reference to FIG. 5, an axial movement regulating mechanism comprises an annular shim 400, annular flange 314*c* and first and second thrust plane bearings 326 and 327. These elements cooperate to regulate axial movement of drive shaft 314. Annular shim 400 is preferably disposed between annular flange 314*c* and an internal component, for example, second annular sleeve 311*d*. More preferably, annular shim 400 is disposed between the front end surface of first thrust plane bearing 326 and the rear end surface of second annular sleeve 311*d* of front end plate 311. Annular shim 400 may be detachably secured to the rear end surface of second annular sleeve 311*d* by, for example, a plurality of flush screws 401. An end surface of a head portion of each flush screw 401 is preferably located slightly forward of a rear end surface of annular shim 400. First thrust plane bearing 326 is fixedly disposed on the rear end surface of shim 400 by a plurality of fixing pins 326*a*. An outer diameter of shim 400 is about equal to that of first thrust plane bearing 326, and an inner diameter of shim 400 is preferably slightly smaller than that of first thrust plane bearing 326.

In order to minimize the positive tolerant axial air gap (G) created between the rear end surface of first thrust plane bearing 326 and the front end surface of annular flange 314*c*, and the positive tolerant axial air gap (H) created between the front end surface of second thrust plane bearing 327 and the rear end surface of annular flange 314*c*, annular shim 400 is selected from shims having various thicknesses according to the following steps.

In a first step, before assembly of the compressor 300, the following distances (Q), (R) and (S) are measured. (Q) is distance between the from end surface of front annular projection 321 of inner block 320 and the bottom end surface of shallow annular depression 320*a*. (R) is the distance between the rear end surface of front end plate 311 and the rear end surface of second annular sleeve 311*d* of front end plate 311. (S) is the distance between the front end surface of annular flange 314*c* and the rear end surface of annular flange 314*c*, i.e., the thickness of annular flange 314*c*.

In a second step, annular shim 400 having thickness (T) is selected by calculating (T) according to the following formula (1).

$$(T)=(Q)-(R)-(S)-2(U) \quad (1)$$

In formula (1), (U) equals the thickness of either of the substantially identical first and second thrust plane bearings 326 and 327 including a positive tolerance thereof.

Annular shim 400 having thickness (T) is detachably disposed on the rear end surface of second annular sleeve 311*d* of from end plate 311 by, for example, a plurality of flush screws 401 during a process of assembling the compressor 300.

As a result, the positive tolerant axial air gap (G) created between the rear end surface of first thrust plane bearing 326 and the front end surface of annular flange 314*c* is equal to about two times the positive tolerance of either of the substantially identical first and second thrust plane bearings 326 and 327. Similarly, the positive tolerant axial air gap (H) created between the front end surface of second thrust plane bearing 327 and the rear end surface of annular flange 314*c* is also equal to about two times the positive tolerance of either of the substantially identical first and second thrust plane bearings 326 and 327. Further, since each of the substantially identical first and second thrust plane bearings 326 and 327 is preferably a standardized product, each of the positive tolerant axial air gaps (G) and (H) is thereby minimized to be, for example, on the order of about 0.01 mm–0.05 mm. More preferably, gaps (G) and (H) are each on the order of about 0.01 mm–0.03 mm.

Accordingly, the offensive noise and the abnormal abrasion caused by collisions at the contact surfaces between annular flange 314*c* and first thrust plane bearing 326 and between annular flange 314*c* and second thrust plane bearing 327 are effectively eliminated.

Figure 5A:
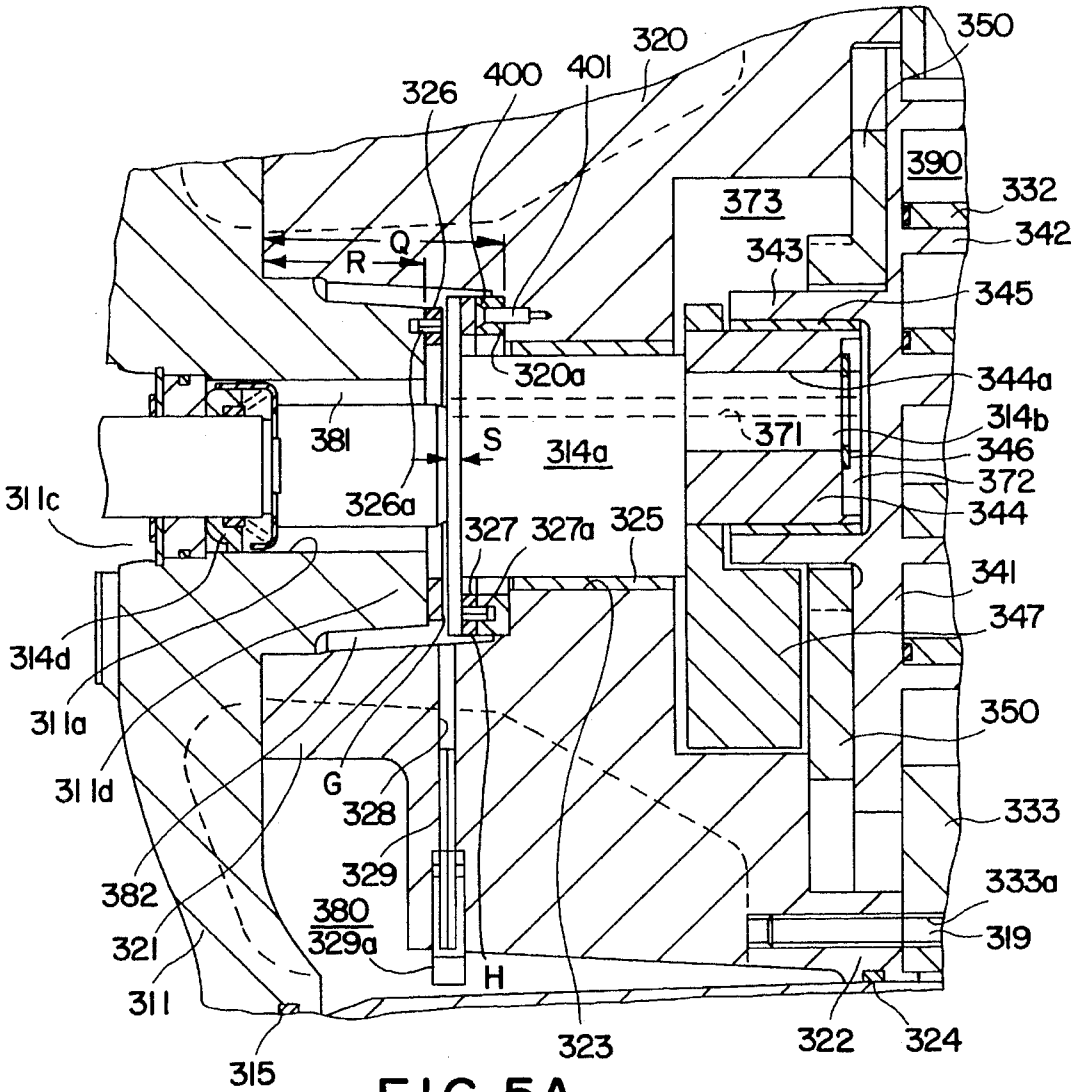
FIG. 5A is a modification of FIG. 5.

In FIG. 5, annular shim 400 is shown disposed between the front end surface of first thrust plane bearing 326 and the rear end surface of second annular sleeve 311*d* of front end plate 311. Of course, as shown in FIG. 5A, annular shim 400 may alternately be disposed between the rear end surface of second thrust plane bearing 327 and the front end surface of inner block 320.

Figure 6:
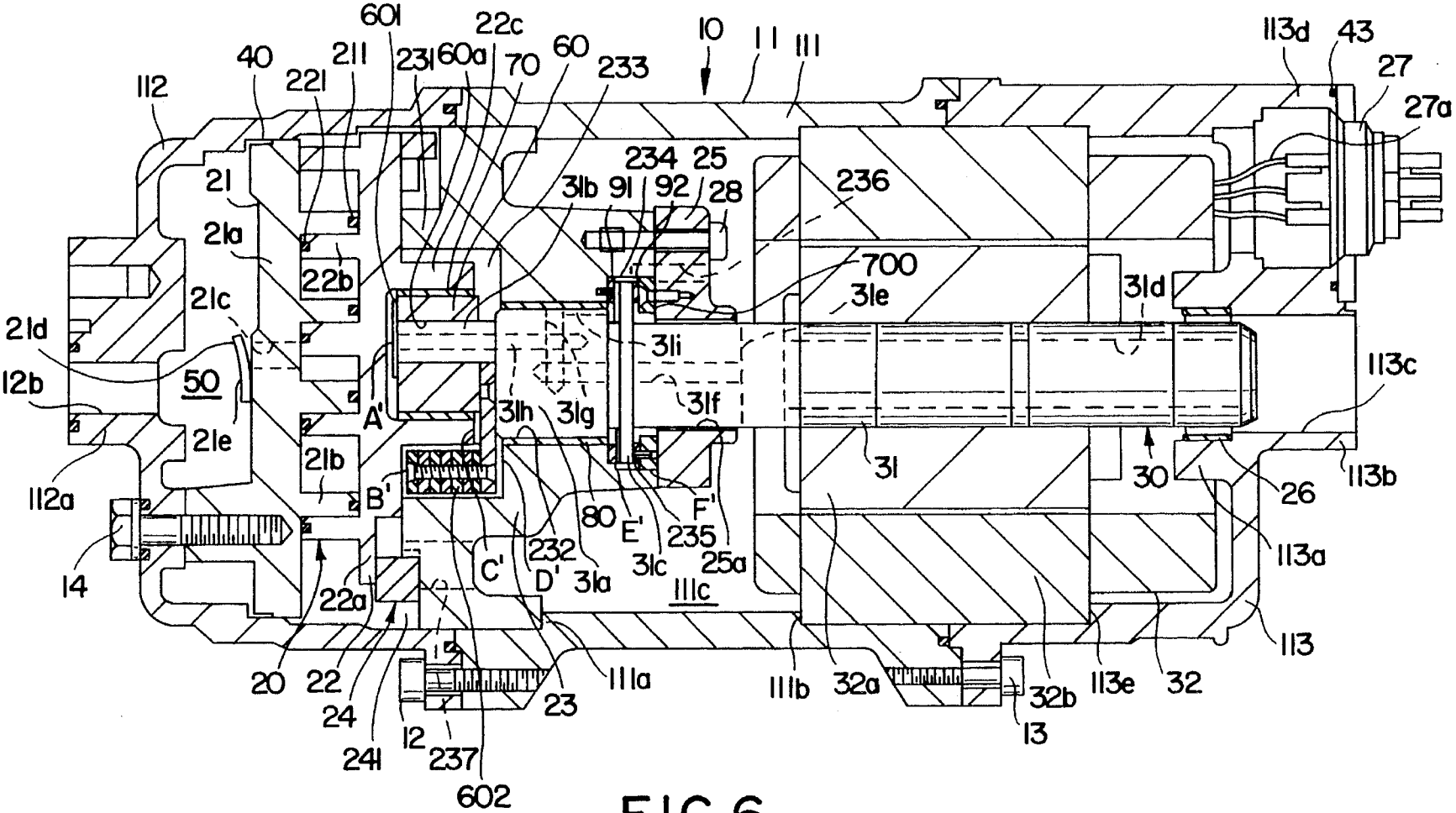
FIG. 6 is a cross-sectional view of a scroll-type fluid displacement apparatus in accordance with a second embodiment of the present invention.
Figure 7:
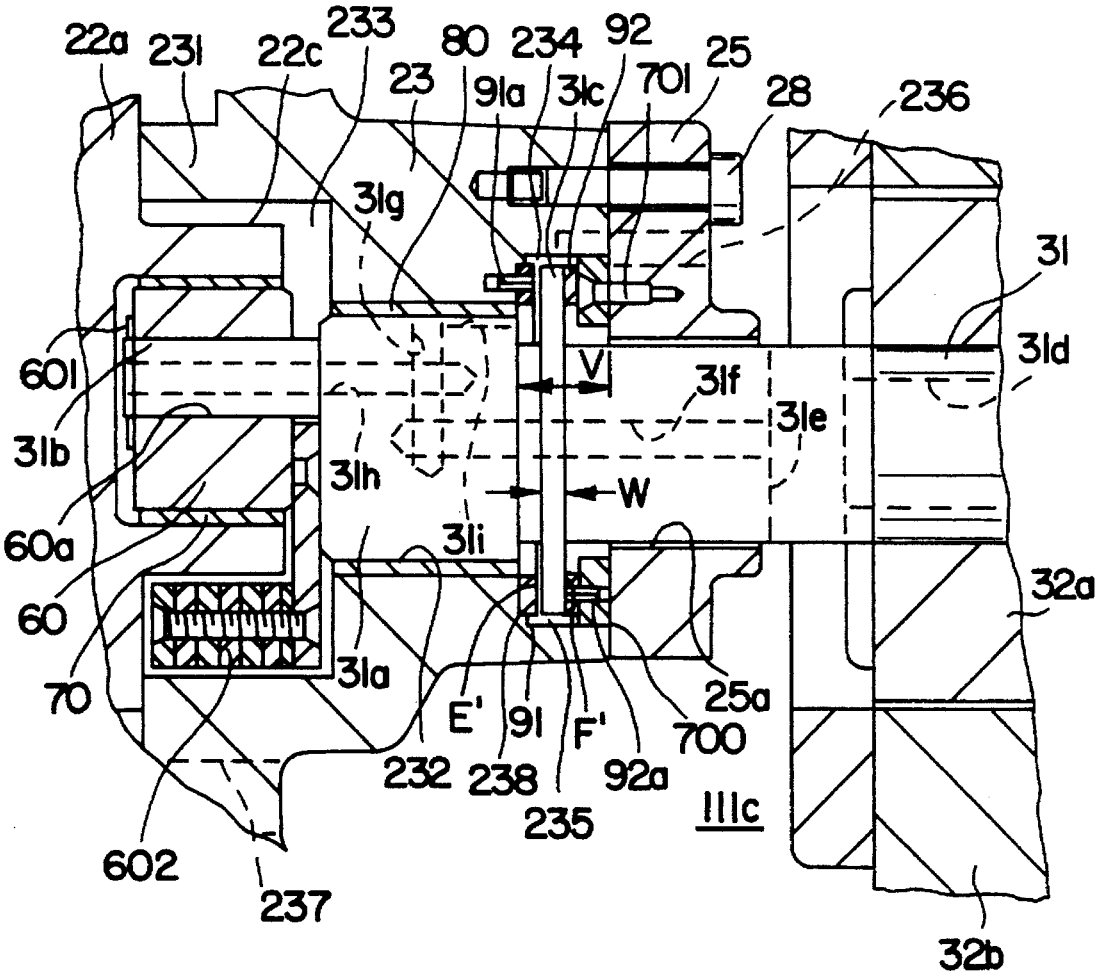
FIG. 7 is an enlarged partial cross-sectional view of the scroll-type fluid displacement apparatus shown in FIG. 6.

With reference to FIGS. 6 and 7, a scroll-type fluid displacement apparatus, such as a motor driven scroll-type refrigerant compressor, is shown in accordance with a second embodiment of the present invention. In FIGS. 6 and 7, for purposes of explanation only, the left side of the figures will be referred to as the forward end or front of the compressor, and the right side of the figures will be referred to as the rearward end or rear of the compressor.

Referring to FIG. 6, an overall construction of the motor driven scroll-type refrigerant compressor is shown. Compressor 10 includes compressor housing 11, which contains a compression mechanism, such as a scroll-type fluid compression mechanism 20, and a driving mechanism 30 therein. Compressor housing 11 includes cylindrical portion 111, and first and second cup-shaped portions 112 and 113. An opening end of first cup-shaped portion 112 is releasably and hermetically connected to a front opening end of cylindrical portion 111 by a plurality of bolts 12. An opening end of second cup-shaped portion 113 is releasably and hermetically connected to a rear opening end of cylindrical portion 111 by a plurality of bolts 13. A detailed manner of connecting first cup-shaped portion 112 to cylindrical portion 111 and second cup-shaped portion 113 to cylindrical portion 111 is described in U.S. Pat. No. 5,312,234, so that an explanation thereof is omitted.

Scroll-type fluid compression mechanism 20 includes fixed scroll 21 having circular end plate 21*a* and spiral element 21*b*, which rearwardly extends from circular end plate 21*a*. Circular end plate 21*a* of fixed scroll 21 is fixedly disposed within first cup-shaped portion 112 by a plurality of bolts 14. Inner block 23 is fixedly disposed at the front opening end of cylindrical portion 111 of compressor housing 11 by, for example, forcible insertion. An outer periphery of a rear end surface of inner block 23 is in contact with a side wall of first annular ridge 111*a* which is formed at an inner peripheral surface of cylindrical portion 111. Scroll-type fluid compression mechanism 20 further includes orbiting scroll 22 having circular end plate 22*a* and spiral element 22*b*, which forwardly extends from circular end plate 22*a*. Spiral element 21*b* of fixed scroll 21 interfits with spiral element 22*b* of orbiting scroll 22 with angular and radial offsets.

Seal element 211 is disposed at an end surface of spiral element 21*b* of fixed scroll 21 so as to seal the mating surfaces of spiral element 21*b* of fixed scroll 21 and circular end plate 22*a* of orbiting scroll 22. Similarly, seal element 221 is disposed at an end surface of spiral element 22*b* of orbiting scroll 22 so as to seal the mating surfaces of spiral element 22*b* of orbiting scroll 22 and circular end plate 21*a* of fixed scroll 21. O-ring seal element 40 is elastically disposed between an outer peripheral surface of circular end plate 21*a* of fixed scroll 21 and an inner peripheral surface of first cup-shaped portion 112 to seal the mating surfaces of circular end plate 21*a* of fixed scroll 21 and first cup-shaped portion 112. Circular end plate 21*a* of fixed scroll 21 and first cup-shaped portion 112 define discharge chamber 50.

Circular end plate 21*a* of fixed scroll 21 is provided with discharge port 21*c* axially formed therethrough so as to link discharge chamber 50 to a central fluid pocket (not shown) which is defined by fixed and orbiting scrolls 21 and 22. A reed valve member (not shown) is associated with discharge port 21*c* at a front end surface of circular end plate 21*a* of fixed scroll 21 to control the opening and closing of discharge port 21*c* in response to a pressure differential between discharge chamber 50 and the central fluid pocket.

Retainer 21*d* is associated with the reed valve member to prevent excessive bending of the reed valve member in a situation when discharge port 21*c* is opened. The reed valve member is fixedly secured to circular end plate 21*a* of fixed scroll 21 by a single screw 21*e* together with one end of retainer 21*d*.

First cup-shaped portion 112 includes cylindrical projection 112*a* forwardly projecting from an outer surface of a front end section thereof. The compressed fluid is discharged from the central fluid pocket through the valved discharge port 21*c* and into discharge chamber 50. Axial hole 112*b*, functioning as an outlet port for compressor 10 is centrally formed through cylindrical projection 112*a* so as to be connected to an inlet of an element, such as a condenser (not shown) of a refrigerant circuit (not shown), through a pipe member (not shown). Accordingly, the compressed fluid in discharge chamber 50 flows to the inlet of the condenser of the refrigerant circuit via axial hole 112*b* and the pipe member.

Orbiting scroll 22 further includes an annular boss 22*c* which rearwardly projects from a central region of a rear end surface of circular end plate 22*a*. Bushing 60 is rotatably disposed within boss 22*c* through radial plane bearing 70. Radial plane bearing 70 is fixedly disposed within boss 22*c* by, for example, forcible insertion. Bushing 60 has a hole 60*a* axially formed therethrough. An axis of hole 60*a* is radially offset from an axis of bushing 60.

Driving mechanism 30 includes drive shaft 31 and motor 32 surrounding drive shaft 31. Drive shaft 31 comprises cylindrical rotor 31*a* which is integral with and coaxially projects from an inner end surface of drive shaft 31. A diameter of cylindrical rotor 31*a* is greater than that of drive shaft 31.

Inner block 23 includes front annular projection 231 projecting from a front end surface thereof. Front annular projection 231 surrounds boss 22*c* and forms a part of Oldham coupling mechanism 24. Opening 232, which is concentric with the longitudinal axis of cylindrical portion 111 of housing 11 is centrally formed through inner block 23. Cylindrical rotor 31*a* of drive shaft 31 is rotatably supported by inner block 23 through radial plane bearing 80 which is fixedly disposed within opening 232. Radial plane bearing 80 is fixedly disposed within opening 232 by, for example, forcible insertion. Pin member 31*b* is integral with and projects from a front end surface of cylindrical rotor 31*a*. An axis of pin member 31*b* is radially offset from an axis of cylindrical rotor 31*a*, i.e., an axis of drive shaft 31, by a predetermined distance.

Referring to FIG. 7, pin member 31*b* is rotatably disposed within hole 60*a* of bushing 60. A terminal end portion of pin member 31*b* extends forward beyond a front end surface of bushing 60, and snap ring 601 is fixedly secured to the terminal end portion of pin member 31*b* to prevent an axial movement of pin member 31*b* within hole 60*a* of bushing 60. Counter balance weight 602 is disposed within cylindrical depression 233, which is formed at a central region of the front end surface of inner block 23. Counter balance weight 602 is connected to a rear end portion of bushing 60. Annular flange 31*c* is formed at an exterior surface of drive shaft 31 rearward of cylindrical rotor 31*a* and is located within cylindrical depression 234, which is formed at a central region of the rear end surface of inner block 23. A diameter of annular flange 31*c* is greater than that of cylindrical rotor 31*a*. Disk-shaped plate 25 is fixedly connected to the rear end surface of inner block 23 by a plurality of bolts 28. Therefore, cylindrical depression 234 is enclosed by disk-shaped plate 25, thereby defining cylindrical chamber 235. Hole 25*a* is formed through disk-shaped plate 25 for penetration of drive shaft 31. Hole 25*a* surrounds a part of drive shaft 31 with a small radial air gap.

Referring again to FIG. 6, second cup-shaped portion 113 includes annular cylindrical projection 113*a* forwardly projecting from a central region of an inner surface of a bottom end section thereof. Annular cylindrical projection 113*a* is concentric with the longitudinal axis of second cup-shaped portion 113. Radial needle bearing 26 is fixedly disposed within annular cylindrical projection 113*a* so as to rotatably support a rear end portion of drive shaft 31. Second cup-shaped portion 113 further includes cylindrical projection 113*b* rearwardly projecting from a central region of an outer surface of the bottom end section thereof.

Axial hole 113*c*, functioning as an inlet port of the compressor, is centrally formed through cylindrical projection 113*b* so as to be connected to an outlet of another element, such as an evaporator (not shown) of the refrigerant circuit (not shown) through a pipe member (not shown). Axial hole 113*c* is concentric with the longitudinal axis of annular cylindrical projection 113*b*. A diameter of axial hole 113*c* is slightly smaller than an inner diameter of annular cylindrical projection 113*a*, but is slightly greater than an outer diameter of drive shaft 31.

Annular cylindrical projection 113*d* rearwardly projects from a peripheral region of the outer surface of the bottom end section of second cup-shaped portion 113. A portion of annular cylindrical projection 113*d* is integral with a portion of cylindrical projection 113*b*. Hermetic seal base 27 is firmly secured to a rear end of annular cylindrical projection 113*d* by a plurality of bolts (not shown). O-ring seal element 43 is elastically disposed at a rear end surface of annular cylindrical projection 113*d* so as to seal the mating surfaces of hermetic seal base 27 and annular cylindrical projection 113*d*. Wires 27*a* are connected at one end to motor 32, and pass through hermetic seal base 27 for connection at the other end to an external electric power source (not shown).

Motor 32 includes annular-shaped rotor 32*a* fixedly surrounding an exterior surface of drive shaft 31 and annular-shaped stator 32*b* surrounding rotor 32*a* with a small radial air gap. Stator 32*b* axially extends along the rear opening end region of cylindrical portion 111 and the opening end region of second cup-shaped portion 113 between a second annular ridge 111*b* formed at an inner peripheral surface of cylindrical portion 111 and third annular ridge 113*e* formed at an inner peripheral surface of second cup-shaped portion 113. Second annular ridge 111*b* is located rearward of first annular ridge 111*a*. The axial length of stator 32*b* is slightly smaller than an axial length between second annular ridge 111*b* and third annular ridge 113*e*. In an assembling process of the compressor, stator 32*b* is forcibly inserted into either the rear opening end region of cylindrical portion 111 until an outer peripheral portion of a front end surface of stator 32*b* is in contact with a side wall of second annular ridge 111*b* or the opening end region of second cup-shaped portion 113 until an outer peripheral portion of a rear end surface of stator 32*b* is in contact with a side wall of third annular ridge 113*e*.

Drive shaft 31 further includes first axial bore 31*d* axially extending therethrough. One end of first axial bore 31*d* is opened at a rear end surface of drive shaft 31 so as to be adjacent to a front opening end of axial hole 113*c*. The other end of first axial bore 31*d* terminates at a position which is rearward of disk-shaped plate 25. A plurality of first radial bores 31*e* are formed at the front terminal end of first axial bore 31*d* so as to link the front terminal end of first axial bore 31*d* to an inner hollow space 111*c* of cylindrical portion 111 of housing 11. Second axial bore 31*f* axially extends from the front terminal end of first axial bore 31*d* and terminates at a middle portion of cylindrical rotor 31*a* of drive shaft 31. A diameter of second axial bore 31*f* is smaller than a diameter of first axial bore 31*d*, and second axial bore 31*f* is concentric with first axial bore 31*d*.

Second radial bore 31*g* radially extends from the front terminal end of second axial bore 31*f* and terminates at an outer peripheral surface of cylindrical rotor 31*a*. Third axial bore 31*h* axially extends from the front terminal end surface of pin member 31*b*, and substantially terminates at a middle portion of second radial bore 31*g*. A diameter of third axial bore 31*h* is about equal to that of second axial bore 31*f*, and the longitudinal axis of third axial bore 31*h* is radially offset from the longitudinal axis of second axial bore 31*f*. Axial passage 31*i* is formed at a peripheral portion of cylindrical rotor 31*a*, and links a radially outer end of second radial bore 31*g* with cylindrical chamber 235. Passage 236 is formed through disk-shaped plate 25 and the rear end portion of inner block 23 so as to link cylindrical chamber 235 to inner hollow space 111*c*.

A plurality of conduits 237 are formed at a radial end portion of inner block 23 so as to link the inner hollow space 111*c* to an inner hollow space 241 formed in first cup-shaped portion 112 between circular end plate 21*a* and inner block 23.

Refrigerant gas travels from an external source, such as the evaporator, into the inner hollow space 111*c* through axial hole 113*c*, first axial bore 31*d* of drive shaft 31 and first radial bores 31*e*. The refrigerant gas in the inner hollow space 111*c* further flows to inner hollow space 241 through conduits 237, and then is taken into the radially outer fluid pockets formed by orbiting scroll 22 and fixed scroll 21. The refrigerant gas in fluid pockets travels centrally with decreasing volume between the scrolls and is discharged into discharge chamber 50 through the valved discharge port 21*c* of the fixed scroll 21.

A part of the refrigerant gas in first radial bores 31*e* flows into second axial bore 31*f*, and then is conducted to the outer peripheral surface of cylindrical rotor 31*a* through second radial bore 31*g* by virtue of centrifugal force, which is generated by the rotation of cylindrical rotor 31*a*. As the refrigerant gas is conducted to the outer peripheral surface of cylindrical rotor 31*a*, the frictional mating surfaces of rotor 31*a* and radial plane bearing 80 are lubricated by lubricating oil suspended in the refrigerant gas. Refrigerant gas at the outer peripheral surface of rotor 31*a* flows into cylindrical chamber 235 through axial passage 31*i*. There, the contacting surfaces between flange 31*c* and first and second thrust bearings 91, 92 are lubricated. The refrigerant gas also flows through passage 236 and merges with the refrigerant gas in inner hollow space 111*c*.

A part of the refrigerant gas flowing through second radial bore 31*g* also flows into cylindrical depression 233 via third axial bore 31*h*, an inner hollow space defined by bushing 60 and a central portion of the circular end plate 22*a*, and a small air gap created between bushing 60 and radial plane bearing 70. As the refrigerant gas flows through the inner hollow space defined by bushing 60 and and circular end plate 22*a*, the contacting surfaces between bushing 60 and snap ring 601 are lubricated. Further, as the refrigerant gas flows through the gap created between bushing 60 and radial plane bearing 70, the frictional mating surfaces of bushing 60 and radial plane bearing 70 are lubricated. Refrigerant gas in cylindrical depression 233 flows through a gap created between the front annular projection 231 of inner block 23 and the circular end plate 22*a*, and then merges with the refrigerant gas in inner hollow space 241.

Referring again to FIG. 7, an axial movement regulating mechanism comprises annular shim 700, annular flange 31*c*, and first and second thrust plane bearings 91 and 92. These elements cooperate to regulate axial movement of drive shaft 31. First thrust plane bearing 91 is fixedly disposed within shallow annular depression 238, which is formed at a rear end surface of inner block 23 along the periphery of opening 232, by a plurality of fixing pins 91*a*. First thrust plane bearing 91 surrounds a rear end portion of radial thrust bearing 80. A rear end surface of first thrust plane bearing 91 faces the front end surface of annular flange 31*c* and slightly projects from a rear end surface of inner block 23. A rear end surface of fixing pins 91*a* is preferably forward of the rear end surface of first thrust plane bearing 91. First thrust plane bearing 91 may be in frictional contact with annular flange 31*c*, and may receive a forward thrust force through annular flange 31*c*.

Annular shim 700 is preferably disposed between annular flange 31*c* and an internal component, for example, disk-shaped plate 25. More preferably, annular shim 700 is disposed between the rear end surface of second thrust plane bearing 92 and the front end surface of disk-shaped plate 25. Annular shim 700 may be detachably secured to the front end surface of disk-shaped plate 25 by, for example, a plurality of flush screws 701. A front end surface of a head portion of each flush screw 701 is preferably rearward of a front end surface of annular shim 700. Second thrust plane bearing 92 is fixedly disposed on the front end surface of shim 700 by a plurality of fixing pins 92*a*. An outer diameter of shim 700 is slightly greater than that of second thrust plane bearing 92, and an inner diameter of shim 700 is slightly smaller than that of second thrust plane bearing 92.

In this embodiment, when the compressor is assembled, positive tolerant axial air gaps are created between the following pairs of adjacent surfaces in order to prevent the defective interferences therebetween.

(A') the adjacent surfaces of pin member 31*b* of drive shaft 31 and circular end plate 22*a* of orbiting scroll 22;

(B') the adjacent surfaces of counter balance weight 602 and Oldham coupling mechanism 24;

(C') the adjacent surfaces of counter balance weight 602 and boss 22*c* of orbiting scroll 22;

(D') the adjacent surfaces of counter balance weight 602 and inner block 23;

(E') the adjacent surfaces of annular flange 31*c* and first thrust plane bearing 91; and (F') the adjacent surfaces of annular flange 31*c* and second thrust plane bearing 92.

Further, in contrast with a conventional bearing device, such as a radial ball bearing which includes inner and outer races and a plurality of ball elements rollingly disposed between the races, no preventing element for preventing axial movement of drive shaft 31 is provided between drive shaft 31 and radial plane bearings 70 and 80 and between drive shaft 31 and radial needle bearing 26. As a result, during operation of the compressor 10, drive shaft 31 may forwardly and rearwardly slide along the inner peripheral surface of radial plane bearings 70 and 80 and along the inner peripheral surface of radial needle bearing 26 due to the positive tolerant axial air gaps described above.

In this embodiment, the positive tolerant axial air gap created between the adjacent surfaces (E') is designed to be smaller than the positive tolerant axial air gaps created between any of the pairs of adjacent surfaces (A'), (B') and (C'). Accordingly, during operation of the compressor 10, as drive shaft 31 forwardly moves, collisions may occur between the adjacent surfaces (E'). The positive tolerant axial air gap created between the adjacent surfaces (F') is designed to be smaller than the positive tolerant axial air gap created between the adjacent surfaces (D'). Accordingly, during operation of the compressor 10, as drive shaft 314 rearwardly moves, collisions may occur between the adjacent surfaces (F').

In order to minimize the positive tolerant axial air gap created between the adjacent surfaces (E'), and the positive tolerant axial air gap created between the adjacent surfaces (F'), annular shim 700 is selected from shims which have various thicknesses, according to the following steps.

In a first step, before assembling the compressor 10, the following distances (V) and (W) (shown in FIG. 7) are measured. (V) is the distance between the bottom surface of cylindrical depression 238 and the rear end surface of inner block 23. (W) is the distance between the front end surface of annular flange 31*c* and the rear end surface of annular flange 31*c*, i.e., the thickness of annular flange 31*c*.

In a second step, after calculating (T') according to the following formula (2), annular shim 700 having thickness (T') is selected.

$$(T')=(V)-(W)-2(U) \quad (2)$$

In formula (2), (U) equals the thickness of either of the substantially identical first and second thrust plane bearings 91 and 92, including a positive tolerance thereof.

Annular shim 700 having thickness (T') is detachably disposed on the front end surface of disk-shaped plate 25 by, for example, a plurality of flush screws 701 during a process of assembling the compressor 10.

As a result, the positive tolerant axial air gap (E') created between the rear end surface of first thrust plane bearing 91 and the front end surface of annular flange 31*c* is about two times the positive tolerance of either of the substantially identical first and second thrust plane bearings 91 and 92. Similarly, the positive tolerant axial air gap (F') created between the front end surface of second thrust plane bearing 92 and the rear end surface of annular flange 31*c* is also about two times the positive tolerance of either of the substantially identical first and second thrust plane bearings 91 and 92. Also, since each of the substantially identical first and second thrust plane bearings 91 and 92 is preferably a standardized product, the positive tolerant axial air gaps (E') and (F') is thereby minimized to be for example, on the order of about 0.01 mm–0.05 mm. More preferably, gaps (E') and (F') are on the order of about 0.01 mm–0.03 mm.

Accordingly, offensive noise and abnormal abrasion caused by collisions at the contact surfaces between annular flange 31*c* and first thrust plane bearing 91 and between annular flange 31*c* and second thrust plane bearing 92 are effectively eliminated.

Figure 7A:
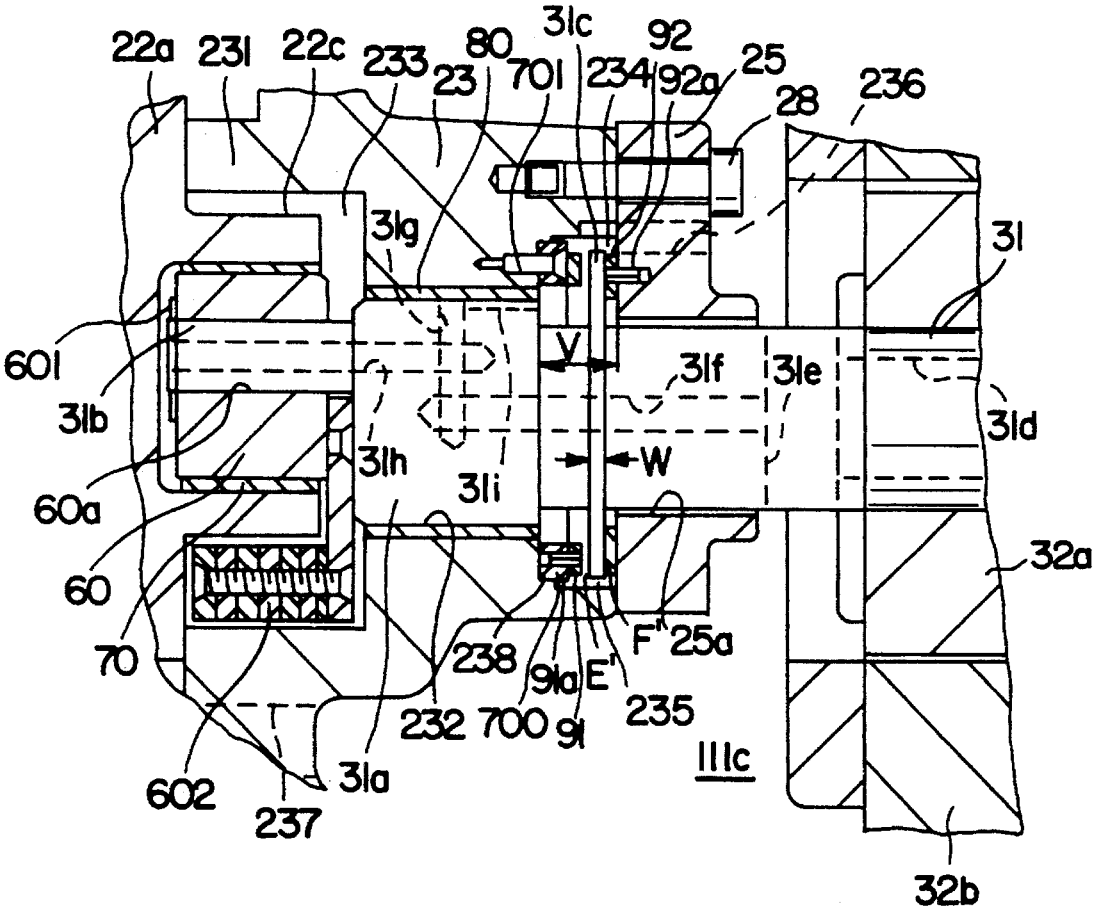
FIG. 7A is a modification of FIG. 7.

As shown in FIGS. 6 and 7, annular shim 700 is disposed between the rear end surface of second thrust plane bearing 92 and the front end surface of disk-shaped plate 25. Of course, as shown in FIG. 7A, annular shim 700 may be alternately disposed between the front end surface of first thrust plane bearing 91 and the rear end surface of inner block 23.

This invention has been described in connection with the preferred embodiments, which are provided for example purposes only. The present invention is not limited thereto. It will be readily apparent to those having ordinary skill in the pertinent art that other variations or modifications can be easily made within the scope of the present invention, which is limited only by the claims that follow.

I claim:

1. A scroll-type fluid displacement apparatus comprising:

a housing;

a fixed scroll disposed within said housing and having a first end plate from which a first spiral element extends;

an orbiting scroll disposed within said housing and having a second end plate from which a second spiral element extends, said first and second spiral elements interfitting at angular and radial offsets to form a plurality of linear contacts defining at least one pair of sealed-off fluid pockets;

a driving mechanism comprising a drive shaft axially disposed in said housing and operatively connected to said orbiting scroll to effect orbital motion of said orbiting scroll;

an inner block fixedly disposed within said housing so as to rotatably support a portion of said drive shaft;

an internal component disposed within said housing and axially spaced apart from said inner block;

a rotation-preventing mechanism coupled to said orbiting scroll to prevent rotation of said orbiting scroll during its orbital motion, such that the volume of said fluid pocket changes; and an axial movement regulating mechanism for regulating axial movement of said driving mechanism, said axial movement regulating mechanism including an annular flange, which radially extends from an exterior surface of said drive shaft and is disposed between an axial end surface of said inner block and an axial end surface of said internal component, wherein a plurality of positive tolerant axial air gaps are formed between adjacent axial end surfaces of a plurality of axially spaced-apart components of said compressor, said axial movement regulating mechanism further comprising a shim detachably disposed between said annular flange and said internal components wherein an axial dimension of a positive tolerant axial air gap between said internal component and said annular flange, less an axial thickness or said shim, is less than an axial dimension of each of said plurality of positive tolerant axial air gaps.

2. The scroll-type fluid displacement apparatus of claim 1 wherein said axial movement regulating mechanism is disposed within an oil passage, which is at least partially defined by said drive shaft and said inner block.

3. The scroll-type fluid displacement apparatus of claim 1 wherein the axial dimension of the positive tolerant axial air gap between said internal component and said annular flange, less the axial thickness of said shim, equals less than about 0.05 mm.

4. The scroll-type fluid displacement apparatus of claim 1 wherein said axial movement regulating mechanism further comprises a first thrust plane bearing disposed between said annular flange and said axial end surface of said inner block, and a second thrust plane bearing disposed between said annular flange and said shim, wherein an axial dimension of a positive tolerant axial air gap between said internal component and said annular flange, less an axial thickness of said shim and less an axial thickness of said second thrust plane bearing, is less than an axial dimension of each of said plurality of positive tolerant axial air gaps.

5. The scroll-type fluid displacement apparatus of claim 4 wherein the axial dimension of the positive tolerant axial air gap between said internal component and said annular flange, less the axial thickness of said shim and less the axial thickness of said second thrust plane bearing, equals less than about 0.05 mm.

6. The scroll-type fluid displacement apparatus of claim 1 wherein said shim is made of steel.

7. The scroll-type fluid displacement apparatus of claim 6 wherein said first thrust plane bearing comprises a first annular element made of steel and a second annular element made of phosphor bronze, said second annular element being disposed on an end surface of said first annular element, such that an end surface of said second annular element faces said annular flange.

8. The scroll-type fluid displacement apparatus of claim 1 wherein said housing hermetically contains said driving mechanism.

9. The scroll-type fluid displacement apparatus of claim 8 wherein said driving mechanism further comprises a motor coupled to said drive shaft to effect rotation of said drive shaft.

10. A scroll-type fluid displacement apparatus comprising:

a housing;

a fixed scroll disposed within said housing and having a first end plate from which a first spiral element extends;

an orbiting scroll disposed within said housing and having a second end plate from which a second spiral element extends, said first and second spiral elements interfitting at angular and radial offsets to form a plurality of linear contacts defining at least one pair of sealed-off fluid pockets;

a driving mechanism comprising a drive shaft axially disposed in said housing and operatively connected to said orbiting scroll to effect orbital motion of said orbiting scroll;

an inner block fixedly disposed within said housing so as to rotatably support a portion of said drive shaft;

an internal component disposed within said housing and axially spaced apart from said inner block;

a rotation-preventing mechanism coupled to said orbiting scroll to prevent rotation of said orbiting scroll during its orbital motion, such that the volume of said fluid pocket changes; and an axial movement regulating mechanism for regulating axial movement of said driving mechanism, said axial movement regulating mechanism including an annular flange, which radially extends from an exterior surface of said drive shaft and is disposed between an axial end surface of said inner block and an axial end surface of said internal component, wherein a plurality of positive tolerant axial air gaps are formed between adjacent axial end surfaces of a plurality of axially spaced-apart components of said compressor, said axial movement regulating mechanism further comprising a shim detachably disposed between said annular flange and said inner block, wherein an axial dimension of a positive tolerant axial air gap between said inner block and said annular flange, less an axial thickness of said shim, is less than an axial dimension of each of said plurality of positive tolerant axial air gaps.

11. The scroll-type fluid displacement apparatus of claim 10 wherein said axial movement regulating mechanism is disposed within an oil passage, which is at least partially defined by said drive shaft and said inner block.

12. The scroll-type fluid displacement apparatus of claim 10 wherein the axial dimension of the positive tolerant axial air gap between said inner block and said annular flange, less the axial thickness of said shim, equals less than about 0.05 mm.

13. The scroll-type fluid displacement apparatus of claim 10 wherein said axial movement regulating mechanism further includes a first thrust plane beating disposed between said annular flange and said axial end surface of said internal component, and a second thrust plane bearing disposed between said annular flange and said shim, wherein an axial dimension of a positive tolerant axial air gap between said inner block and said annular flange, less an axial thickness of said shim and less an axial thickness of said second thrust plane bearing, is less than an axial dimension of each of said plurality of positive tolerant axial air gaps.

14. The scroll-type fluid displacement apparatus of claim 13 wherein the axial dimension of the positive tolerant axial air gap between said inner block and said annular flange, less the axial thickness of said shim and less the axial thickness of said second thrust plane bearing, equals less than about 0.05 mm.

15. The scroll-type fluid displacement apparatus of claim 10 wherein said shim is made of steel.

16. The scroll-type fluid displacement apparatus of of claim 15 wherein said first thrust plane bearing comprises a first annular element made of steel and a second annular element made of phosphor bronze, said second annular element being disposed on an end surface of said first annular element, such that an end surface of said second annular element faces said annular flange.

17. The scroll-type fluid displacement apparatus of claim 10 wherein said housing hermetically contains said driving mechanism.

18. The scroll-type fluid displacement apparatus of claim 17 wherein said driving mechanism further comprises a motor coupled to said drive shaft to effect rotation of said drive shaft.

* * * * *